US011125527B2

(12) United States Patent
Lort

(10) Patent No.: US 11,125,527 B2
(45) Date of Patent: Sep. 21, 2021

(54) VALVE AND RESERVOIR SYSTEM FOR AIRSOFT GUN

(71) Applicant: Wolverine Airsoft LLC, Kingsport, TN (US)

(72) Inventor: Rich Lort, Kingsport, TN (US)

( * ) Notice: Subject to any disclaimer, the term of this patent is extended or adjusted under 35 U.S.C. 154(b) by 925 days.

(21) Appl. No.: 15/454,639

(22) Filed: Mar. 9, 2017

(65) Prior Publication Data

US 2017/0299322 A1 Oct. 19, 2017

Related U.S. Application Data

(60) Provisional application No. 62/305,888, filed on Mar. 9, 2016.

(51) Int. Cl.

| | |
|---|---|
| ***F41B 11/62*** | (2013.01) |
| ***F17C 7/04*** | (2006.01) |
| ***F41B 11/724*** | (2013.01) |
| ***F17C 13/08*** | (2006.01) |
| ***F41B 11/642*** | (2013.01) |
| ***F41B 11/723*** | (2013.01) |

(52) U.S. Cl.

CPC ..... *F41B 11/62* (2013.01); *F17C 7/04* (2013.01); *F17C 13/084* (2013.01); *F41B 11/642* (2013.01); *F41B 11/723* (2013.01); *F41B 11/724* (2013.01); *F17C 2201/0109* (2013.01); *F17C 2201/058* (2013.01); *F17C 2205/0111* (2013.01); *F17C 2205/0115* (2013.01); *F17C 2205/0153* (2013.01); *F17C 2205/0338* (2013.01); *F17C 2221/013* (2013.01); *F17C 2223/013* (2013.01); *F17C 2225/0123* (2013.01); *F17C 2265/06* (2013.01); *F17C 2270/0736* (2013.01)

(58) Field of Classification Search

CPC ..... F41B 11/62; F41B 11/642; F41B 11/723; F41B 11/724; F41C 7/04; F41C 13/084; F17C 7/04; F17C 13/084

USPC ..... 124/75

See application file for complete search history.

(56) References Cited

U.S. PATENT DOCUMENTS

| | | | | |
|---|---|---|---|---|
| 7,527,049 | B2 * | 5/2009 | Sheng | F41B 11/721 124/73 |
| 7,624,727 | B2 * | 12/2009 | Campo | F41B 11/71 124/77 |
| 7,640,925 | B2 * | 1/2010 | Jones | F41B 11/71 124/73 |
| 7,640,926 | B2 | 1/2010 | Jones | |
| 8,272,373 | B2 * | 9/2012 | Masse | F41B 11/71 124/76 |
| 8,336,532 | B2 * | 12/2012 | Masse | F41B 11/721 124/75 |
| 8,453,633 | B2 * | 6/2013 | Tsai | F41B 11/643 124/66 |
| 8,671,928 | B2 * | 3/2014 | Hague | F41B 11/721 124/77 |
| 2006/0090739 | A1 * | 5/2006 | Jones | F41B 11/721 124/73 |

(Continued)

*Primary Examiner* — Joshua E Freeman

(57) ABSTRACT

An air reservoir system is provided that includes a switchable valve to direct input air to an air reservoir, or stored air in the air reservoir to a firing pathway. Various example embodiments of the present general inventive concept may also include an air-saver system to maintain a minimum air pressure in the air reservoir during a firing operation.

11 Claims, 7 Drawing Sheets

(56) References Cited

U.S. PATENT DOCUMENTS

| | | | | |
|---|---|---|---|---|
| 2010/0154767 | A1* | 6/2010 | Masse | F41B 11/723<br>124/77 |
| 2012/0216786 | A1* | 8/2012 | Hadley | F41B 11/646<br>124/66 |
| 2013/0247893 | A1* | 9/2013 | Yang | F41A 21/16<br>124/74 |

* cited by examiner

VALVE AND RESERVOIR SYSTEM FOR AIRSOFT GUN

CROSS-REFERENCE TO RELATED APPLICATIONS

This Application claims the benefit of U.S. Provisional Patent Application Ser. No. 62/305,888, filed on Mar. 9, 2016, the content of which is incorporated herein by reference.

STATEMENT REGARDING FEDERALLY SPONSORED RESEARCH OR DEVELOPMENT

Not Applicable.

FIELD OF INVENTION

The present invention pertains generally to airsoft guns and, more particularly, to a high pressure fluid mechanism to be used in airsoft guns.

BACKGROUND

Airsoft guns are replica weapons that fire spherical non-metallic pellets rather than the lethal ammunition that the replica weapons are based upon. Airsoft also refers to a sport played with these airsoft guns that is similar to paintball, except that the pellets fired by the airsoft guns do not leave a color mark like that left by a paintball, and the participants typically play on the honor system of acknowledging when being hit by a pellet from an opponent's airsoft gun. Along with reduced mess, airsoft guns are typically cheaper to acquire and operate than paintball guns, and can also be used more easily for casual target practice when not engaged in competition. Airsoft guns employ compressed air to fire round these plastic pellets or similar projectiles, usually ranging from 0.12 g to 0.48 g.

Various "firing" mechanisms are known in the art for airsoft guns. For instance, U.S. Pat. No. 7,527,049, issued to Sheng, discloses a pneumatic pusher having a main body, a flow-guiding body, a moving body, and a delivery tube. The flow-guiding body includes a front tube with a smaller diameter and a rear tube with a larger diameter. The delivery tube is mounted on the front tube in such a way that the outer wall of the delivery tube and the inner wall of the main body define a return pressure chamber. A first gas-distributing channel extending from a first air outlet at one side of the main body leads directly to the inner side of the delivery tube. The side of the first air inlet of the main body communicates with a second gas-distributing channel. The second gas-distributing channel includes an exit located at one side of the return pressure chamber of the delivery tube. The air pressure provided through the second gas-distributing channel serves as cushioning force in pushing the delivery tube outwardly.

U.S. Pat. No. 8,453,633, issued to Tsai, discloses a spring-piston airsoft gun that includes a cylinder-and-piston assembly disposed in a barrel to force air through a muzzle end to make a shooting action, and a coil spring disposed to exert a biasing action to drive a piston head of the cylinder-and-piston assembly when changed from a compressed state to a released state. Front and rear anchor shanks are disposed for respectively mounting front and rear coil segments of the coil spring. A major shell and a minor ring are sleeved on the rear anchor shank to permit the coil spring to be sleeved thereon. The minor ring is in frictional contact with and angularly moveable relative to the major shell such that, when the coil spring is released to expand to the released state, the rear coil segment is tensed to drag the minor ring to angularly move therewith so as to minimize the frictional force therebetween.

U.S. Pat. No. 8,671,928, issued to Hague et al. and assigned to Polarstar Engineering & Machine, discloses a pneumatic assembly for a projectile launching system includes a body defining a continuous bore. A nozzle is positioned within the bore adjacent a forward end and is moveable between a rearward position wherein the nozzle facilitates passage of a projectile through a projectile port and a forward position wherein the nozzle prevents passage of a projectile through the projectile port. The nozzle is biased to the forward position and configured for fluid actuation to the rearward position by activation of a first fluid control valve. A valve seat defines an accumulation chamber rearward of the nozzle. A firing valve member is moveable between a forward position wherein the firing valve member fluidly seals a passage through the valve seat and a rearward position wherein the passage is fluidly opened such that fluid in the accumulation chamber is free to flow through the passage and out of the nozzle. Example embodiments of this pneumatic assembly generally include a nozzle spring contained between the rear surface of the nozzle and the front surface of a center cylinder.

U.S. Patent Application Publication No. 2012/0216786, by Hadley and Calvin, teaches a soft impact projectile launcher including a launching mechanism that creates a burst of air or air pressure in order to launch a projectile. The launching mechanism includes an outer cylinder and a spring-loaded piston configured to generate the burst of air. The projectile launcher may also include a projectile reservoir and a loading member that positions projectiles for launching. The projectile launcher can launch projectiles that are made from a superabsorbent polymer and consist of mostly water.

U.S. Patent Application Publication No. 2013/0247893, by Yang, teaches an airsoft gun structure designed to shunt high-pressure air flow during shooting. Therefore, the shunted high-pressure air flow simulates recoils as real bolt-action, single-shot rifles. Also, the ammunition supply includes different cartridges to select one of the supply-type by the users and whether shell case ejection or not. When operates the airsoft gun, the realistic action is achieved to enhance the fun of shooting. Furthermore, the dual hop up system makes the flight path of bullets more stable without shift. Moreover, the safety gasification system could make the supplied amount of the output compressed high pressure air be almost constant to enhance security during operation. The devices disclosed in Yang include a hammer block spring or magazine spring attached to an inner surface of the back block in an inner barrel.

One common problem with conventional airsoft guns is waste of compressed fluid used to power the guns. In a typical firing operation, an initial high pressure gas burst powers the firing mechanism of the airsoft gun to fire the projectile, but expelled gas after and in the later stages of that operation may have little to no effect on the firing, and is therefore wasted. This leads to increased cost, as well as the inconvenience of re-loading the gas supply of the airsoft gun. Thus, there exists a desire to improve the efficiency of airsoft guns to reduce waste of the compressed fluid powering the guns.

BRIEF SUMMARY OF THE INVENTION

According to various example embodiments of the present general inventive concept, an air reservoir system is provided that includes a switchable valve to direct input air to an air reservoir, or stored air in the air reservoir to a firing pathway. Various example embodiments of the present general inventive concept may also include an air-saver system to maintain a minimum air pressure in the air reservoir during a firing operation.

Additional aspects and advantages of the present general inventive concept will be set forth in part in the description which follows, and, in part, will be obvious from the description, or may be learned by practice of the present general inventive concept.

The foregoing and/or other aspects and advantages of the present general inventive concept may be achieved by an air reservoir system to be used in an airsoft gun, including an air input, an air reservoir, a firing path, and a valve configured to be switchable between a first stage in which the valve directs air from the air input to the air reservoir, and a second stage in which the valve directs air from the air reservoir to the firing path.

The foregoing and/or other aspects and advantages of the present general inventive concept may be achieved by a high pressure air cylinder-nozzle assembly including a cylinder frame body, a piston having a nozzle member and a piston base member, the piston base member being configured to move within the cylinder frame body, the piston being configured to move between a forward position and a back position, and the piston base member including a primary piston head surface and a secondary piston head surface, a solenoid, an air reservoir adjacent the piston, and a three-way axial valve to direct air within the cylinder frame body.

The foregoing and/or other aspects and advantages of the present general inventive concept may be achieved by a high pressure cylinder to be used in a gun, including a cylinder frame body, a piston having a nozzle member and a piston base member, the piston base member being configured to move within the cylinder frame body along an axis, the piston base member including a first piston head surface and a second piston head surface, the piston being configured to move between a forward position and a back position, a solenoid, an air reservoir adjacent the piston, and a three-way axial valve to direct air within the cylinder frame body.

The foregoing and/or other aspects and advantages of the present general inventive concept may be achieved by a a high pressure air cylinder to be used in an airsoft gun, including a cylinder frame body, a piston having a nozzle member and a piston base member, the piston base member being configured to move within the cylinder frame body along an axis, and the piston being configured to move between a forward position and a back position, an air reservoir adjacent to the piston, and a three-way axial valve to direct air within the cylinder frame body.

Other features and aspects may be apparent from the following detailed description, the drawings, and the claims.

BRIEF DESCRIPTION OF THE FIGURES

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DETAILED DESCRIPTION

Figure 1:
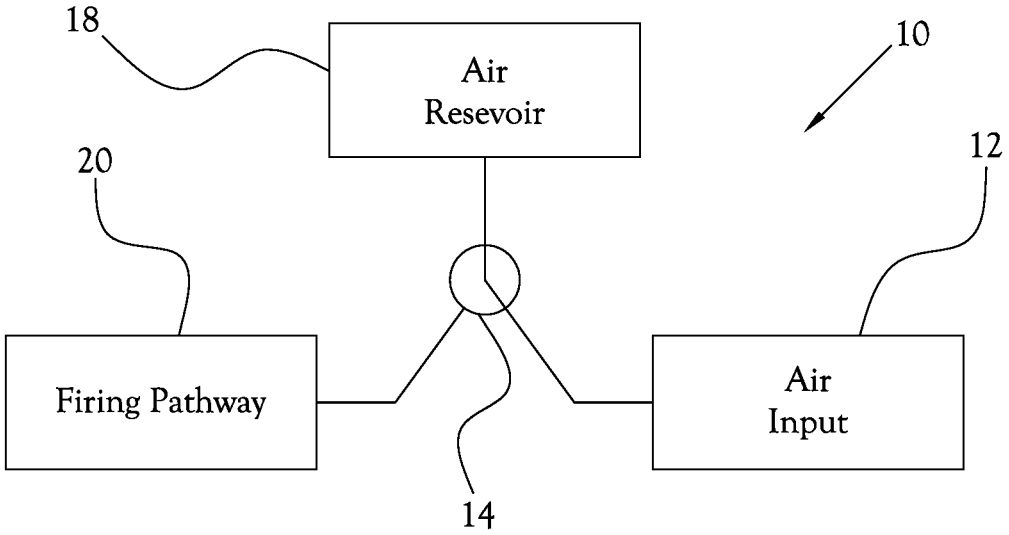
FIGS. 1-2 illustrate a box diagram of general components of a high pressure air supply assembly of an airsoft gun in different functional stages according to an example embodiment of the present general inventive concept.

Reference will now be made to the example embodiments of the present general inventive concept, examples of which are illustrated in the accompanying drawings and illustrations. The example embodiments are described herein in order to explain the present general inventive concept by referring to the figures.

The following detailed description is provided to assist the reader in gaining a comprehensive understanding of the structures and fabrication techniques described herein. Accordingly, various changes, modification, and equivalents of the structures and fabrication techniques described herein will be suggested to those of ordinary skill in the art. The progression of fabrication operations described are merely examples, however, and the sequence type of operations is not limited to that set forth herein and may be changed as is known in the art, with the exception of operations necessarily occurring in a certain order. Also, description of well-known functions and constructions may be simplified and/or omitted for increased clarity and conciseness.

Note that spatially relative terms, such as "up," "down," "right," "left," "beneath," "below," "lower," "above,"

"upper" and the like, may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

According to various example embodiments of the present general inventive concept, an air reservoir system is provided that includes a switchable valve to direct input air to an air reservoir, or stored air in the air reservoir to a firing pathway. Various example embodiments of the present general inventive concept may also include an air-saver system to maintain a minimum air pressure in the air reservoir during a firing operation. In the various descriptions herein, the terms "air", "compressed air", and "pressurized air" may be used interchangeably, and may refer to either pressurized air or gas, such as $CO_2$. Also, while the example embodiments described herein typically refer to airsoft guns, it is understood that these assemblies and systems may also be incorporated in other gas powered guns or similar high pressure air devices and systems.

In various example embodiments, compressed air enters the system through an air input, and a valve, in the first state or condition, directs the air from the air input to the reservoir; that is, the air input "charges" the reservoir. Next, the valve shifts, changing to a second state or condition, in which the valve closes off the air input. In this second state, air leaves the reservoir and passes through the valve into the firing pathway.

Some example embodiments include an "air-saver" component: generally a biased piston that acts as a cut-off valve to regulate the passage of pressurized air into and out of the reservoir. When the air input is charging the reservoir with air, the air pressure within the reservoir drives the piston away from the valve, compressing a spring or other biasing device, until the air pressure within the reservoir reaches its predetermined maximum (e.g. about 140 psi). When the valve shifts and air begins to leave the reservoir, the pressure within the reservoir drops and the spring expands, driving the piston towards the valve. When the pressure within the reservoir drops below a certain pre-determined threshold pressure (e.g. 70-80 psi), the piston closes off the reservoir, so that no further air can escape from the reservoir. In this way, the reservoir maintains an elevated "baseline" air pressure; and during the next charging cycle, when air is fed from the air input into the reservoir, the system needs only to add as much pressurized air as is necessary to increase the pressure within the reservoir from, e.g., 80 psi to 140 psi. Thus, the spring-loaded piston "air-saver" assembly can economize upwards of 50% of the pressurized air used during each cycle of the system. In some other example embodiments, the reservoir system is used without an air-saver assembly, or may use a differently configured air-saver assembly. In various example embodiments, a three-way axial valve and air reservoir act in concert with a moving piston connected to the nozzle of the airsoft gun.

Figure 2:
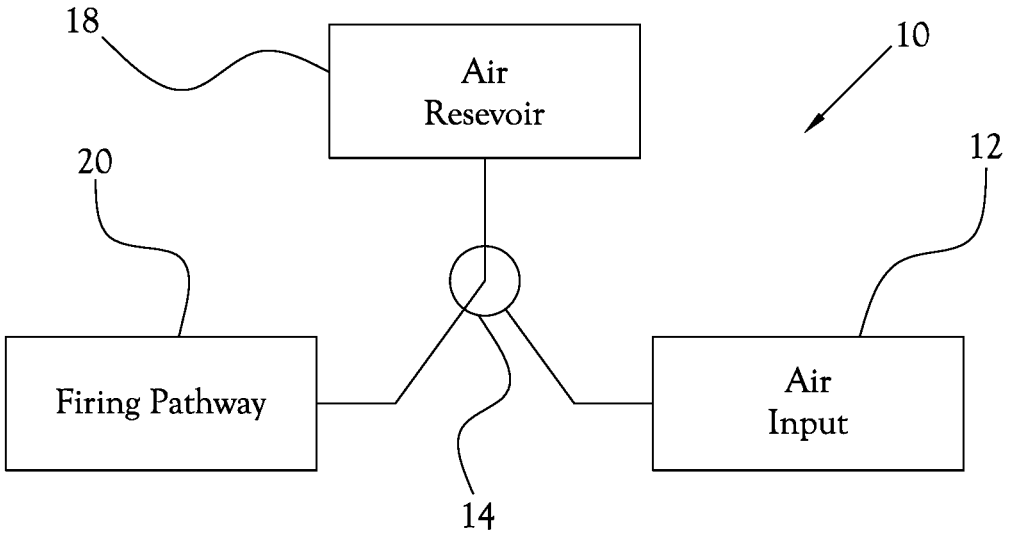

FIGS. 1-2 illustrate a box diagram of general components of a high pressure air supply assembly of an airsoft gun in different functional stages according to an example embodiment of the present general inventive concept. The example embodiment illustrated in FIG. 1 shows a high pressure air supply assembly 10 including an air input 12, a 3-way axial valve 14 (which may be generally referred to as a "valve" in the descriptions herein), an air reservoir 18, and a firing pathway 20. In the stage illustrated in FIG. 1, the 3-way axial valve 14 is in a first position, providing an air passage connecting the air input 12 to the air reservoir 18, so that the compressed air from the air input 12 is moving through the valve 14 and into the air reservoir 18, increasing the air pressure therein. Increasing the air and air pressure in the air reservoir 18 results in "charging" the reservoir 18, so that a firing operation may be performed.

FIG. 2 illustrates the assembly 10 of FIG. 1 in a second stage, when a firing operation is actuated. In FIG. 2, the valve 14 is switched so that the pressurized air in the air reservoir 18 is routed through the valve 14 and into the firing pathway 20 to be used to fire a projectile. In the first stage illustrated in FIG. 1, the air path between the firing pathway 20 and the air reservoir 18 is closed, and in the second stage illustrated in FIG. 2, the air path between the air input 12 and the air reservoir 18 is closed. Thus, air from the air input 12 is only passed through when charging the air reservoir 18, and is not passed from the air input 12 during the firing operation.

Figure 3:
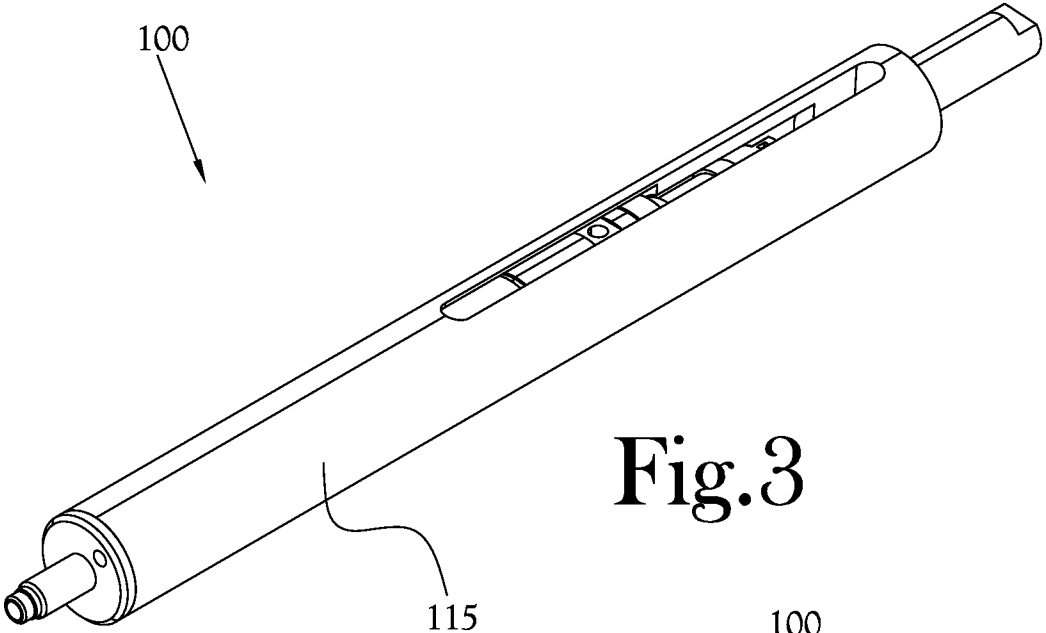
FIG. 3 illustrates a perspective view of a bolt housing containing an air reservoir system according to an example embodiment of the present general inventive concept.
Figure 4:
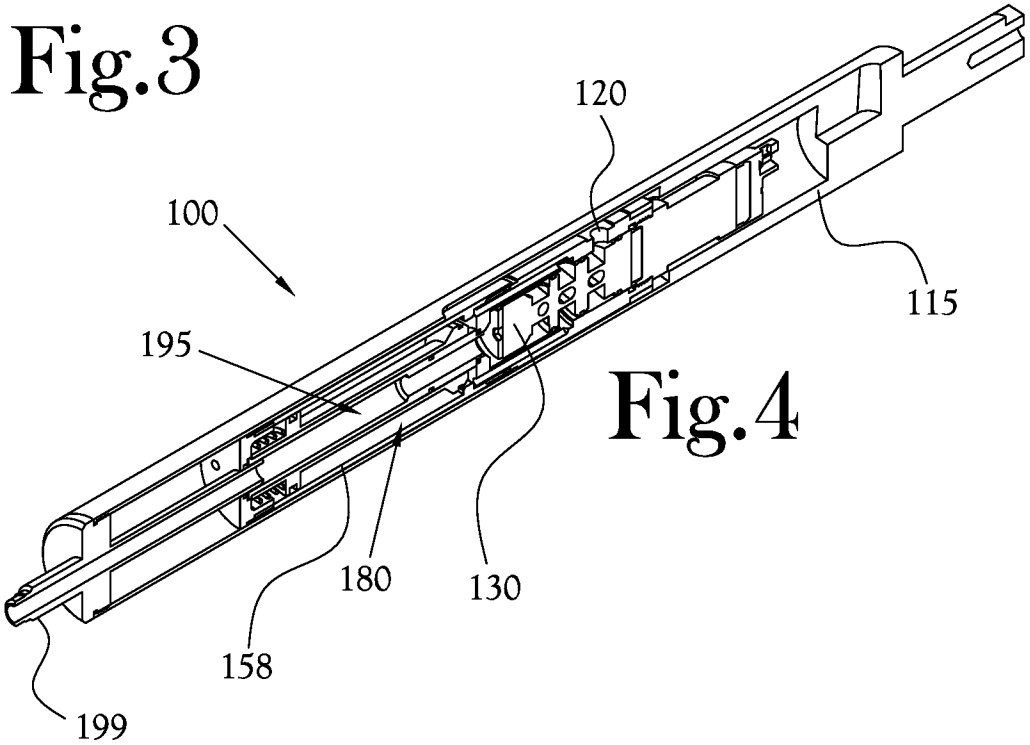
FIG. 4 illustrates a perspective cross-section of the example embodiment illustrated in FIG. 3.
Figure 5:
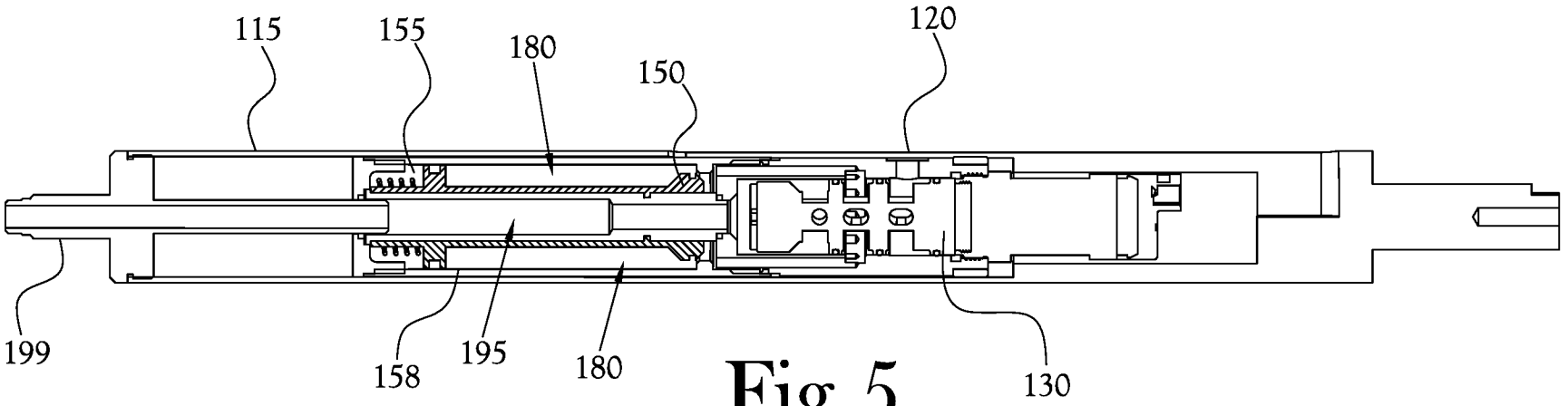
FIG. 5 illustrates a cross-section of the example embodiment illustrated in FIG. 4.

FIG. 3 illustrates a perspective view of a bolt housing containing an air reservoir system according to an example embodiment of the present general inventive concept, FIG. 4 illustrates a perspective cross-section of the example embodiment illustrated in FIG. 3, and FIG. 5 illustrates a cross-section of the example embodiment illustrated in FIG. 4. FIG. 3 illustrates the bolt housing 115 for an airsoft gun that contains the reservoir system 100 therein in this example embodiment of the present general inventive concept. As illustrated in FIGS. 4-5, the bolt housing 115 and reservoir system 100 has an air input 120 through which air is input to the valve 130 of the reservoir system 100. In the first stage or condition of the operation, the valve 130 controls the air such that it is directed to the reservoir 180. In other words, in the first stage of the operation the compressed air is used to "charge" the reservoir 180. To continue a firing operation of the airsoft gun, the valve 130 shifts to a second stage or condition in which the valve 130 closes off the air input 120. In this second stage, the compressed air leaves the reservoir 180, passing through the valve 130 into the firing pathway 195. In the example embodiment illustrated in FIGS. 3-5, the firing pathway 195 leads directly to the nozzle 198, where the exiting pressurized air contacts the projectile (BB, etc.) and sets the projectile into motion, i.e., "fires" the projectile. In various example embodiments, the firing pathway 195 leading from the valve 130 and reservoir 180 may direct the air in other ways and/or to other locations, and the airsoft gun may employ a different type of firing mechanism. The present general inventive concept is not limited to the example embodiment illustrated in FIGS. 3-5.

The example embodiment illustrated in FIGS. 3-5 also includes an "air-saver" component that helps conserve the use of the pressurized air in the reservoir 180 during use of the airsoft gun. As illustrated in FIG. 5, the reservoir system 100 includes a spring-loaded piston 150 configured to move within an air cylinder 158 to regulate the passage of pressurized air into and out of the reservoir 180. In this example embodiment, the piston 150 is biased by the spring 155 in the direction of the valve 130 so as to close off passage of pressurized air into and out of the reservoir 180 from and to the valve 130. When pressurized air from the air input 120 is directed to the reservoir 180 from the valve 130 to charge the reservoir 180, the air pressure within the reservoir 180 pushes the piston 150 away from the valve 130, compressing the spring 155, until the air pressure within the reservoir 180 reaches its predetermined maximum. In various example embodiments, the predetermined maximum air pressure within the reservoir 180 may be approximately 140 psi. When the valve 130 is actuated to the second stage or condition to actuate firing of the airsoft gun, the valve 130 shifts to stop supplying compressed air to the reservoir from the air input 120, and to start directing the compressed air in the reservoir 180 to the firing pathway 195. As the compressed air leaves the reservoir 180, the pressure within the reservoir 180 drops, which allows the spring 155 to begin pushing the piston 150 in the direction of the valve. When the air pressure within the reservoir drops below a predetermined threshold pressure, the piston 150 closes off the reservoir 180 so that no further air can escape from the reservoir to the valve 130 and firing pathway 195. In various example embodiments of the present general inventive concept, the predetermined threshold pressure in the reservoir 180 below which the piston 150 closes the reservoir 180 may be approximately 70-80 psi. Through the operations of the described air-saver system of this example embodiment, the reservoir 180 is able to maintain an elevated "baseline" air pressure. Thus, during the next charging cycle, when air is fed from the air input 120 into the reservoir 180, the system 100 need only add as much pressurized air as is necessary to increase the pressure within the reservoir from, e.g., approximately 80 psi, to approximately 140 psi. Thus, the spring-loaded piston "air-saver" assembly can economize upwards of 50% of the pressurized air used during each cycle of the system, which decreases the cost of operation of the airsoft gun, along with increasing the convenience of use by decreasing the number of times that an air supply to the air input 120 must be changed out.

Figure 6:
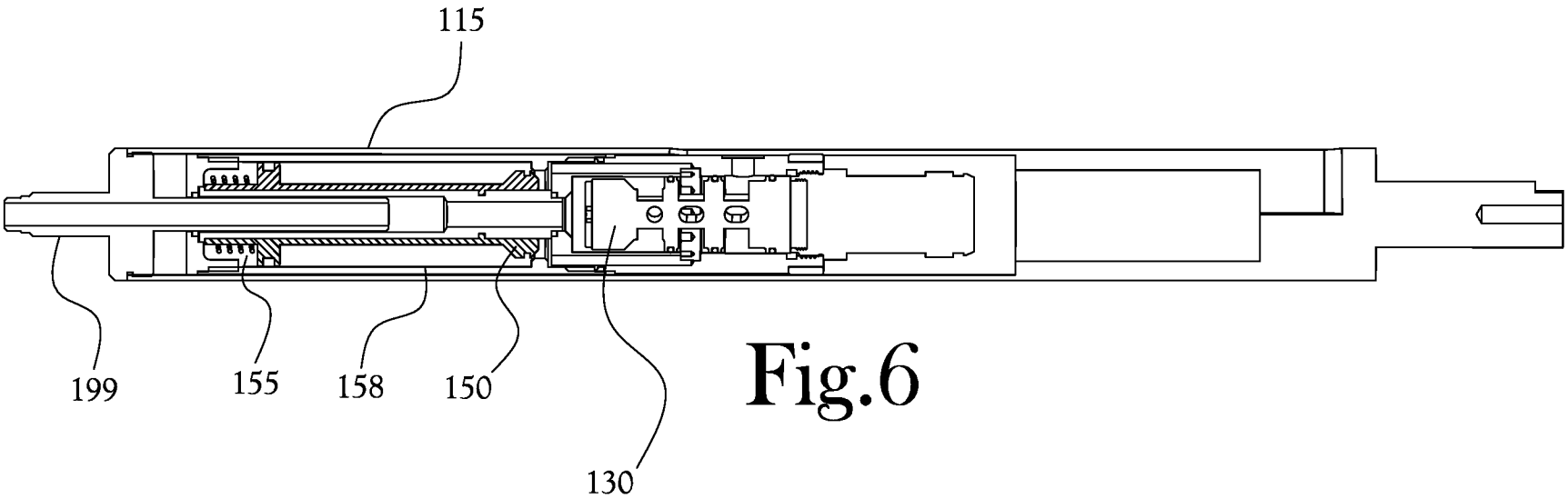
FIG. 6 illustrates the example embodiment of FIG. 5 in the middle of a bolt action cycling operation, in which the bolt housing has been moved backwards to load a projectile according to an example embodiment of the present general inventive concept.

The example embodiment illustrated in FIGS. 3-5 is a variant for use in an airsoft gun in which a bolt slides to cycle the action of the firing mechanism. More precisely, the airsoft gun with a bolt slide uses manual cycling of the bolt action to load the next projectile to be fired from the airsoft gun. FIGS. 5-6 illustrate the movement of the bolt housing 115 during such a manual cycling. In FIG. 5, the bolt housing 115 is in a forward position, having been cycled through a loading operation such that the projectile is loaded and ready to be fired. FIG. 6 illustrates the example embodiment of FIG. 5 in the middle of a bolt action cycling operation, in which the bolt housing 115 has been moved backwards to allow the airsoft gun ammunition loading mechanism (not shown) to load the next projectile for firing. In various example embodiments, the reservoir system 100 is used in conjunction with a manual sliding bolt action as illustrated in FIGS. 5-6. In various other example embodiments, the reservoir system may be used in conjunction with different styles of action, such as, for example, automatic or semi-automatic feeds.

Figure 7:
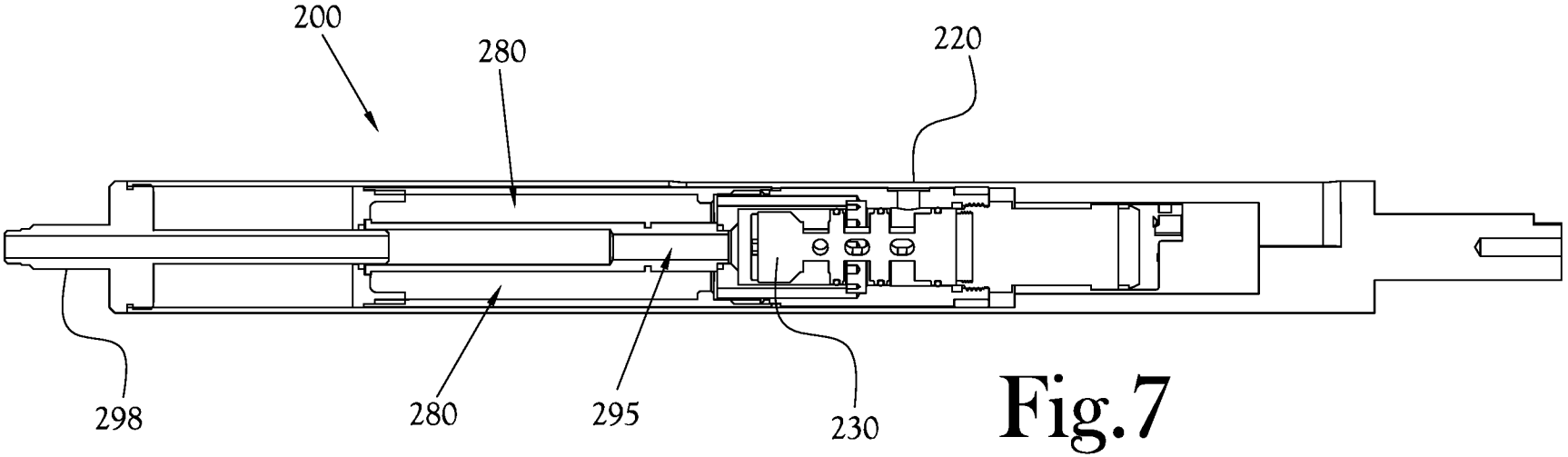
FIG. 7 illustrates a reservoir system that does not include an air-saver assembly according to an example embodiment of the present general inventive concept.

In various example embodiments, the reservoir system may be used with an air-saver assembly, as illustrated in FIGS. 4-6. In various other example embodiments, the reservoir system may be used without an air-saver assembly. FIG. 7 illustrates a reservoir system that does not include an air-saver assembly according to an example embodiment of the present general inventive concept. The example embodiment illustrated in FIG. 7 is similar to the embodiment illustrated in FIG. 5, but does not include the spring-driven piston air-saver assembly. In the example embodiment illustrated in FIG. 7 a reservoir system 200 includes an air input 220 that connected to a valve 230 that is switchable between a first stage in which compressed air from the air input 220 is supplied to the air reservoir 280, and a second stage in which the compressed air in the "charged" air reservoir 280 is directed to a firing path 295, which is connected to a nozzle 298. Since no air-saver assembly is included in this example embodiment, the air pressure in the reservoir 280 is simply controlled by the switching of the valve 230. In various example embodiments, the valve 230 may be controlled to close the connection between the reservoir 280 and the firing pathway 295 after a predetermined amount of time to maintain at least some of the charge of the reservoir 280.

Figure 8:
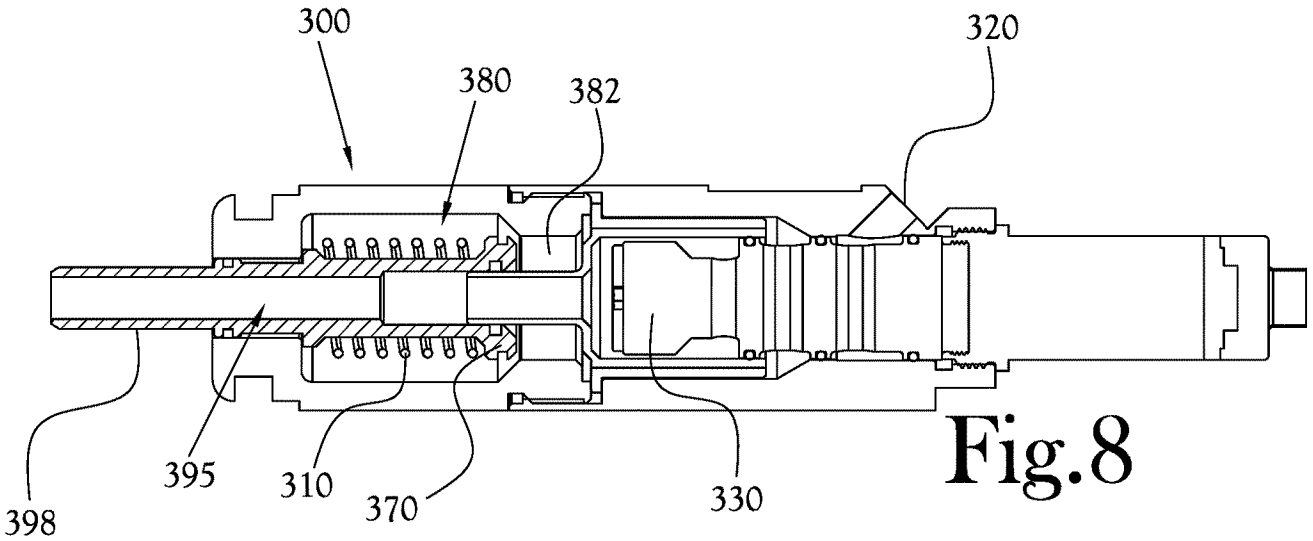
FIG. 8 illustrates a reservoir system having a spring-loaded air saver system that is integrated with the nozzle of the system according to an example embodiment of the present general inventive concept, in which the reservoir system is shown in a first stage thereof.

In various example embodiments, an air reservoir system may be used with a spring-loaded piston that is integrally connected with the nozzle. FIG. 8 illustrates a reservoir system having a spring-loaded air saver system that is integrated with the nozzle of the system according to an example embodiment of the present general inventive concept. In the example embodiment illustrated in FIG. 8 a reservoir system 300 includes a valve 330 that is switchable between a first stage that directs compressed air from an air input 320 to an air reservoir 380, and a second stage that directs the compressed air from the charged reservoir 380 to a firing pathway 395, which leads to a nozzle 398. The nozzle 398 is formed integrally with a piston 370 used as an air-saver system, and which operates in a manner similar to that illustrated in FIGS. 4-5. Similarly to that illustrated in FIGS. 4-5 above, a spring 310 is provided and configured to bias the piston 370 toward the valve 330. A trailing portion of the piston 370 is sized and shaped such that, when the piston moves toward the valve 330, a rearward section 382 of the reservoir 380 is closed off from the remainder of the reservoir 380. In this rearward position, air flow between the reservoir 380 and the valve 330 is cut off, so that no air can escape from the reservoir 380 to the valve 330 and into the firing pathway 395.

In a first stage of the air reservoir system, shown in FIG. 8, in which the valve 330 directs air from the air input 320 into the rearward section 382 of the reservoir 380, air pressure begins to build in the rearward section 382 of the reservoir 380 and exert forward force on the piston 370. Once a certain threshold pressure in the rearward section 382 is reached, the rearward force exerted on the piston 370 by the spring 310 is overcome by the forward force exerted on the piston 370 by the air supplied to the rearward section 382 of the reservoir 380. At this point, the air supplied to the rearward section 382 of the reservoir 380 pushes the piston 370 to a forward position away from the valve 330, as shown in FIG. 8. In this position, the rearward section 382 of the reservoir 380 is opened to the remainder of the reservoir 380, air from the valve 330 is supplied to the remainder of the reservoir 380, and the reservoir 380 achieves a fully "charged" state of air pressure.

Figure 9:
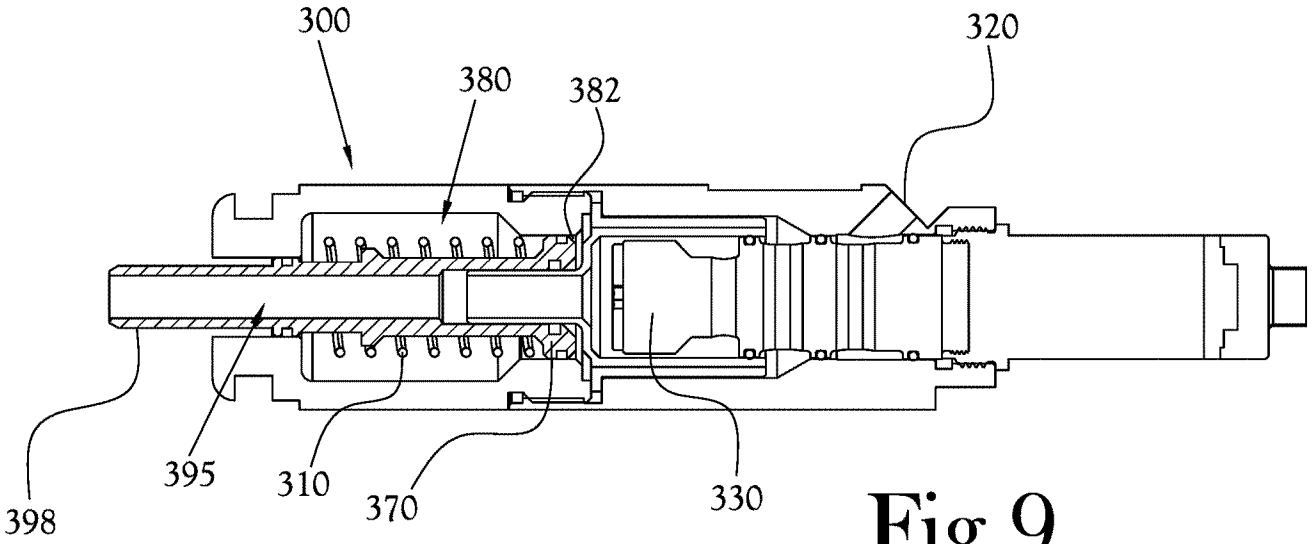
FIG. 9 illustrates a reservoir system having a spring-loaded air saver system that is integrated with the nozzle of the system according to an example embodiment of the present general inventive concept, in which the reservoir system is shown in a second stage thereof.

In a second stage of the air reservoir system, shown in FIG. 9, the valve 330 shifts to discontinue air supply from the air input 320 and to direct air from the rearward section 382 of the reservoir 380 into the firing pathway 395. At this point, air from the reservoir 380, including the rearward section 382, begins to flow outwardly into the firing pathway 395. Once a portion of the air pressure within the rearward section 382 is depleted such that the forward force exerted on the piston 370 by the air supplied to the rearward section 382 of the reservoir 380 is no longer sufficient to overcome the rearward force exerted on the piston 370 by the spring 310, the piston begins to travel rearward toward the valve 330. As discussed above, once the trailing end of the piston 370 enters the rearward section 382, the piston 370 closes off air flow between the rearward section 382 and the remainder of the reservoir 380. As the piston continues to travel rearward into the rearward section 382, the air pressure within the rearward section 382 is depleted, while a minimum threshold air pressure is maintained within the remainder of the reservoir 380. Upon full depletion of the air pressure in the rearward section 382 and full rearward movement of the piston 370, the air reservoir system is returned to the first stage, in which the valve 330 once again begins to supply air from the air input 320 into the rearward section 382 of the reservoir 380, the piston 370 returns to the forward-most position, and the cycle begins again.

In various embodiments, the rearward and forward movement of the spring-loaded piston 370 and nozzle 398 may automatically cycle a reloading operation as air leaves the rearward portion 308 of the reservoir 380. For example, in various embodiments, in the first stage of the air reservoir system, in which the piston 370 is in a forward-most position, a projectile feeding system, such as for example a projectile magazine or the like, may be positioned adjacent the nozzle 398, such that in this position, the nozzle at least partially restricts movement of additional projectiles from the feeding system into the firing pathway 395. Following shifting of the valve 330 to the above-discussed second stage of the air reservoir system, the rearward movement of the piston 370 and nozzle 398 may serve to allow movement of a projectile from the feeding system into the firing pathway 395. The subsequent return of the valve 330 to the above-discussed first stage and accompanying forward movement of the piston 370 may serve to feed the projectile into a firing chamber of a gun.

Various example embodiments of the present general inventive concept may include an air reservoir system with a spring-less air-saver assembly. FIGS. 10-13 illustrate cross-sections of a reservoir system having a spring-less air-saver assembly according to an example embodiment of the present general inventive concept. FIGS. 10-13 are cross-sections of the same assembly, but in which the assembly has been rotated 90 degrees in FIGS. 11 and 13 to more clearly illustrate the physical configuration of this example embodiment. In the example embodiment illustrated in FIGS. 10-13, similar to the previously described example embodiments, an air reservoir system 900 includes an air input 920, an air reservoir 940, a firing pathway 980, and a valve 930 that is switchable to either direct air from the air input 920 to the reservoir 940, or from the reservoir 940 to the firing pathway 980. However, in this example embodiment, compressed air is further supplied from the air input 920 to a forward air chamber 960 through an air pathway 970 to increase the air pressure in the forward air chamber 960. In various example embodiments, the forward air chamber 960 is configured to receive constant air supply from the air input 920 through the air pathway 970 throughout the various actions of the valve 930 as discussed hereinbelow, such that the forward air chamber 960 maintains a fully "charged" air pressure.

In the illustrated embodiment, an integrated nozzle and piston 950 is provided having a forward annular lip 910 which is disposed along, and closes off, a pathway between the forward air chamber 960 and the air reservoir 940. A rearward annular lip 990 is defined by rearward surfaces of the nozzle and piston 950 and is disposed along a rearward portion 982 of the air reservoir 940. In a manner somewhat similar to the above-discussed spring 310 and piston 370 assembly, pressurized air within the forward air chamber 960 pushes against the forward annular lip 910 to bias the nozzle and piston 950 toward the rearward portion 982 of the air reservoir 940. Likewise, the rearward annular lip 990 is sized and shaped such that, when received within the rearward portion 982 of the air reservoir 940, the rearward annular lip 990 closes off the rearward portion 982 of the air reservoir 940 from the remainder of the air reservoir 940.

Figure 10:
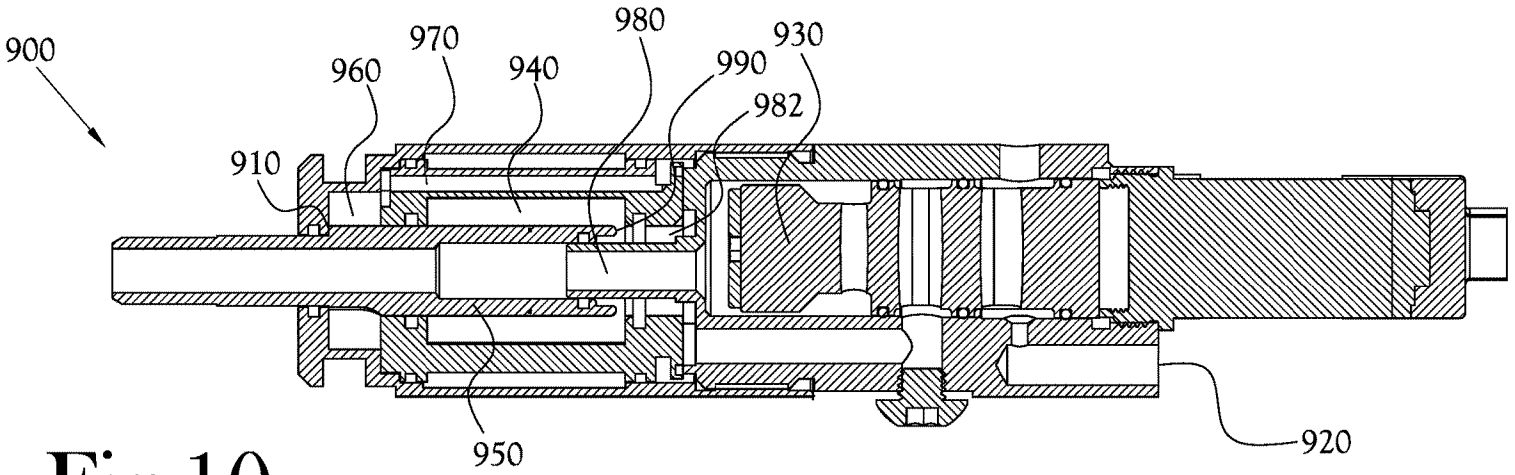
FIG. 10 illustrates a cross-section of a reservoir system having a spring-less air-saver assembly according to an example embodiment of the present general inventive concept, in which the reservoir system is shown in a first stage thereof.
Figure 11:
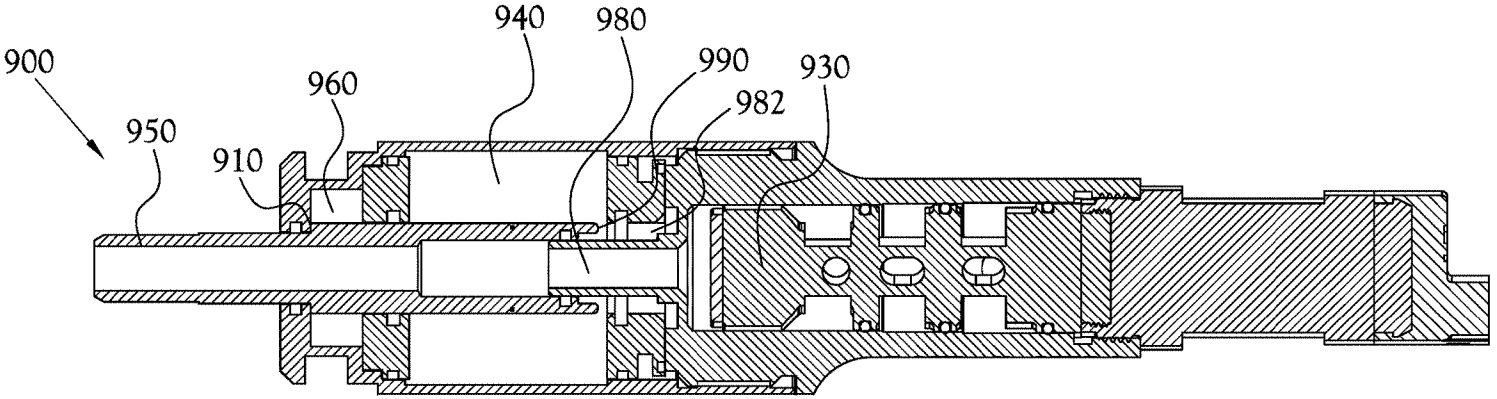
FIG. 11 illustrates an alternate cross-section view of the reservoir system of FIG. 10.

In a first stage of the air reservoir system, shown in FIGS. 10-11, the valve 930 directs air from the air input 920 into the rearward section 982 of the reservoir 940. In this configuration, the air pressure within the forward air chamber 960 and the rearward section 982 of the reservoir 940 are of a substantially equal force per unit area. However, in the illustrated embodiment, the rearward annular lip 990 is of a slightly larger surface area than the surface area of the forward annular lip 910. Thus, in this first stage, the forward force exerted on the nozzle and piston 950 by the pressurized air supplied to the rearward section 982 of the reservoir 940 is greater than the rearward force exerted on the nozzle and piston 950 by the pressurized air supplied to the forward air chamber 960. Accordingly, in this first stage, as shown in FIGS. 10-11, the air supplied to the rearward section 982 of the reservoir 940 pushes the nozzle and piston 950 to a forward position away from the valve 930. In this position, the rearward section 982 of the reservoir 940 is opened to the remainder of the reservoir 940, air from the valve 930 is supplied to the remainder of the reservoir 940, and the reservoir 940 achieves a fully "charged" state of air pressure substantially matching that of the forward air chamber 960.

Figure 12:
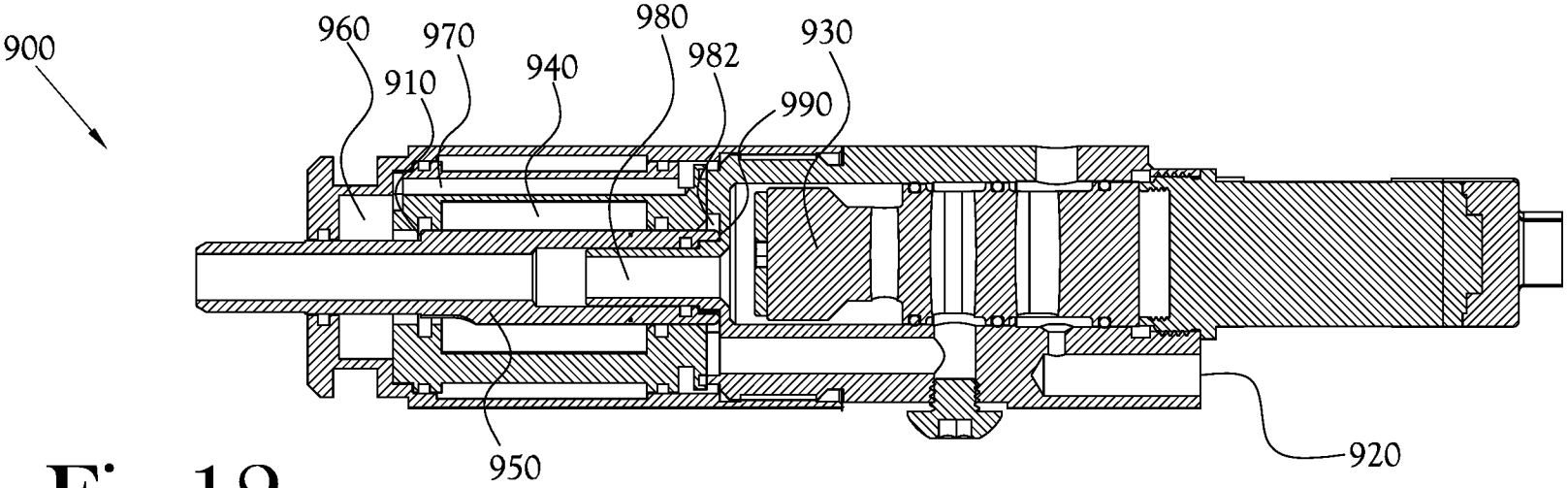
FIG. 12 illustrates a cross-section of a reservoir system having a spring-less air-saver assembly according to an example embodiment of the present general inventive concept, in which the reservoir system is shown in a second stage thereof.
Figure 13:
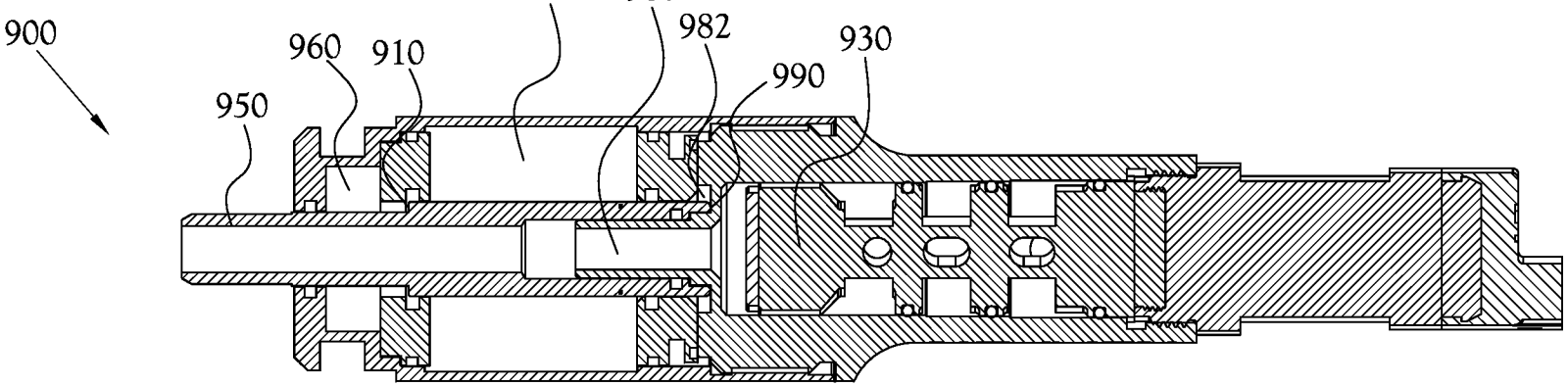
FIG. 13 illustrates an alternate cross-section view of the reservoir system of FIG. 12.

In a second stage of the air reservoir system, shown in FIGS. 12-13, the valve 930 shifts to direct air from the rearward section 982 of the reservoir 940 into the firing pathway 980. At this point, air from the reservoir 940, including the rearward section 982, begins to flow outwardly into the firing pathway 985. Once a portion of the air pressure within the rearward section 982 is depleted such that the forward force exerted on the nozzle and piston 950 by the air supplied to the rearward section 982 of the reservoir 940 is no longer sufficient to overcome the rearward force exerted on the nozzle and piston 950 by the air supplied to the forward air chamber 960, the nozzle and piston begins to travel rearward toward the valve 930 and into the rearward section 982 of the reservoir 940.

As discussed above, once the rearward annular lip 990 is received within the rearward portion 982 of the air reservoir 940, the rearward annular lip 990 closes off air flow between the rearward portion 982 of the air reservoir 940 and the remainder of the air reservoir 940. As the nozzle and piston 950 continues to travel rearward into the rearward section 982, the air pressure within the rearward section 982 is depleted, while a minimum threshold air pressure is maintained within the remainder of the reservoir 940. Upon full depletion of the air pressure in the rearward section 982 and full rearward movement of the nozzle and piston 950, the air reservoir system is returned to the first stage, in air is once again supplied from the air input 920 to both the forward air chamber 960 and the rearward section 982 of the reservoir 940. At this point, the nozzle and piston 950 returns to the forward-most position illustrated in FIGS. 10-11, and the cycle begins again.

Numerous variations, modifications, and additional embodiments will be recognized by one of skill in the art, and all such variations, modifications, and embodiments are to be regarded as being within the spirit and scope of the present general inventive concept. For example, in various example embodiments of the present general inventive concept, the nozzle and piston may not be formed as a single integrated member. In various other example embodiments of the present general inventive concept, the forward chamber 960 may be charged at various times throughout the above- described cycle of the valve 930.

Various example embodiments of the present general inventive concept may provide an air reservoir system to be used in an airsoft gun, including an air input, an air reservoir, a firing path, and a valve configured to be switchable between a first stage in which the valve directs air from the air input to the air reservoir, and a second stage in which the valve directs air from the air reservoir to the firing path. The valve may be configured to direct air from the air input to the air reservoir until a predetermined maximum air pressure threshold is reached in the air reservoir. The system may further include a piston member through which the firing path is provided, and which is configured to close an airway between the air reservoir and the firing path in response to a predetermined minimum air pressure threshold being reached in the air reservoir. The system may further include an elastic member to bias the piston member in a direction to close the airway between the air reservoir and the firing path. The elastic member may be a spring. The piston member may be configured to open the airway between the air reservoir and the firing path in response to an air pressure threshold in the air reservoir being higher than the predetermined minimum air pressure. The system may further include a forward air chamber configured to receive air from the air input and to bias the piston member to close the airway between the air reservoir and the firing path in response to a force on the piston member from a current air pressure in the forward air chamber being higher that a force on the piston member from a current air pressure in the air reservoir. The forward air chamber may receive a constant air supply from the air input. The forward air chamber may receive an air supply from the valve during the first stage. The system may further include a nozzle at an end of the firing path, wherein the nozzle is integrated with the piston member. The integrated nozzle and piston member may be configured to actuate a reloading operation of the airsoft gun during each firing cycle. The air reservoir system may be formed in a high pressure air cylinder. The high pressure air cylinder may be configured to be slidable in a bolt housing.

Various example embodiments of the present general inventive concept may provide a high pressure air cylinder-nozzle assembly including a cylinder frame body, a piston having a nozzle member and a piston base member, the piston base member being configured to move within the cylinder frame body, the piston being configured to move between a forward position and a back position, and the piston base member including a primary piston head surface and a secondary piston head surface, a solenoid, an air reservoir adjacent the piston, and a three-way axial valve to direct air within the cylinder frame body. The high pressure air cylinder-nozzle assembly may be configured to be used in an airsoft gun. The high pressure air cylinder-nozzle assembly may further include a spring positioned within the cylinder frame body to bias the piston toward the back position.

Various example embodiments of the present general inventive concept may provide a high pressure cylinder to be used in a gun, including a cylinder frame body, a piston having a nozzle member and a piston base member, the piston base member being configured to move within the cylinder frame body along an axis, the piston base member including a first piston head surface and a second piston head surface, the piston being configured to move between a forward position and a back position, a solenoid, an air reservoir adjacent the piston, and a three-way axial valve to direct air within the cylinder frame body. The first piston head surface and the second piston head surface may be configured as opposing surfaces of the piston base member.

Various example embodiments of the present general inventive concept may provide a high pressure air cylinder to be used in an airsoft gun, including a cylinder frame body, a piston having a nozzle member and a piston base member, the piston base member being configured to move within the cylinder frame body along an axis, and the piston being configured to move between a forward position and a back position, an air reservoir adjacent to the piston, and a three-way axial valve to direct air within the cylinder frame body.

Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

It is noted that the simplified diagrams and drawings included in the present application do not illustrate all the various connections and assemblies of the various components, however, those skilled in the art will understand how to implement such connections and assemblies, based on the illustrated components, figures, and descriptions provided herein, using sound engineering judgment. Numerous variations, modification, and additional embodiments are possible, and, accordingly, all such variations, modifications, and embodiments are to be regarded as being within the spirit and scope of the present general inventive concept.

While the present general inventive concept has been illustrated by description of several example embodiments, and while the illustrative embodiments have been described in detail, it is not the intention of the applicant to restrict or in any way limit the scope of the general inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings. Additional modifications will readily appear to those skilled in the art. Accordingly, departures may be made from such details without departing from the spirit or scope of applicant's general inventive concept.

The invention claimed is:

1. An air reservoir system to be used in an airsoft gun, comprising:

an air input;

an air reservoir;

a firing path; and a valve configured to be switchable between a first stage in which the valve directs air from the air input to the air reservoir, and a second stage in which the valve directs air from the air reservoir to the firing path and an airway between the air input and the air reservoir is closed;

wherein the air reservoir system is formed in a high pressure air cylinder, wherein the high pressure air cylinder is configured to be slidable in a bolt housing.

2. The system of claim 1, wherein the valve is configured to direct air from the air input to the air reservoir until a predetermined maximum air pressure threshold is reached in the air reservoir.

3. The system of claim 1, further comprising a piston member through which the firing path is provided, and which is configured close an airway between the air reservoir and the firing path in response to a predetermined minimum air pressure threshold being reached in the air reservoir.

4. The system of claim 3, further comprising an elastic member to bias the piston member in a direction to close the airway between the air reservoir and the firing path.

5. The system of claim 4, wherein the elastic member is a spring.

6. The system of claim 3, wherein the piston member is configured to open the airway between the air reservoir and the firing path in response to an air pressure threshold in the air reservoir being higher than the predetermined minimum air pressure.

7. The system of claim 3, further comprising a forward air chamber configured to receive air from the air input and to bias the piston member to close the airway between the air reservoir and the firing path in response to a force on the piston member from a current air pressure in the forward air chamber being higher that a force on the piston member from a current air pressure in the air reservoir.

8. The system of claim 7, wherein the forward air chamber receives a constant air supply from the air input.

9. The system of claim 7, wherein the forward air chamber receives an air supply from the valve during the first stage.

10. The system of claim 3, further comprising a nozzle at an end of the firing path, wherein the nozzle is integrated with the piston member.

11. The system of claim 10, wherein the integrated nozzle and piston member are configured to actuate a reloading operation of the airsoft gun during each firing cycle.

* * * * *